US006375393B1

(12) United States Patent
Migliorini

(10) Patent No.: US 6,375,393 B1
(45) Date of Patent: Apr. 23, 2002

(54) APPARATUS FOR THE AUTOMATIC ORIENTATION OF TUBULAR ARTICLES SUCH AS STOCKINGS

(75) Inventor: Pier Lorenzo Migliorini, Terranuova Bracciolini (IT)

(73) Assignee: Matec S.p.A. (IT)

( * ) Notice: Subject to any disclaimer, the term of this patent is extended or adjusted under 35 U.S.C. 154(b) by 0 days.

(21) Appl. No.: 09/525,378

(22) Filed: Mar. 15, 2000

(30) Foreign Application Priority Data

Mar. 23, 1999 (IT) ..... FI99A0058

(51) Int. Cl.[7] ..... B65G 51/18

(52) U.S. Cl. ..... 406/181; 406/3; 406/12; 406/73

(58) Field of Search ..... 406/3, 12, 73, 406/181, 183

(56) References Cited

U.S. PATENT DOCUMENTS 3,574,409 A * 4/1971 Furstenberg ..... 302/27
4,099,789 A * 7/1978 Zaglio ..... 302/2 R
4,653,963 A * 3/1987 Taneda et al. ..... 406/70

FOREIGN PATENT DOCUMENTS

| | | | |
|---|---|---|---|
| EP | 0 521 206 A1 * | 1/1993 | ..... D05B/23/00 |
| GB | 0 737 769 A1 | 10/1996 | |
| IT | FI/96/A/163 | 7/1996 | |
| IT | 0 818 570 A1 | 1/1998 | |

* cited by examiner

*Primary Examiner*—Joseph E. Valenza
*Assistant Examiner*—Joe Dillon, Jr.
(74) *Attorney, Agent, or Firm*—McGlew and Tuttle, P.C.

(57) ABSTRACT

Apparatus for the automatic orientation of tubular articles, such as stockings and the like, in which one end is thicker than the other, comprising a tubular chamber (1) with an inlet section (I) and an outlet section (U) for, respectively, the admission and exit of the articles (2), characterized in that said chamber (1) is provided with two cascade filter-valves (3, 30) each of which, when in operating condition, prevents the passage of the thicker end (21) and allows the passage of the thinner end (20) of the articles to be treated, said chamber (1) exhibiting a branch (10) whose mouth is in correspondence of the space between said filter-valves (3, 30) and being associated, in conjunction with its branch (10), to an aspirator (9) by means of which an air flow is generated able to convey the in-process articles as desired.

7 Claims, 2 Drawing Sheets

APPARATUS FOR THE AUTOMATIC ORIENTATION OF TUBULAR ARTICLES SUCH AS STOCKINGS

The present invention refers to an apparatus for the automatic orientation of tubular articles, such as stockings and the like, in which one end is thicker than the other.

It is known that in the manufacturing of pantyhose articles, two stockings are sewn together in correspondence of a cut line to form the relevant bodice. To this end, machines are used, commonly known as "LINE CLOSERS", which allow feeding the stockings suitably oriented with respect to their support shapes and usually dial-like disposed in a circular carrousel structure. Similarly, for the sewing of stocking toes, machines are used, commonly known as "TOE-CLOSERS", which also imply feeding the stockings suitably oriented with respect to their support tubes commonly provided on such machines.

In this field, a crucial requirement is the automatic supply of articles to these machines, which implies to operate the automatic, instantaneous detection of the articles and their correct positioning, especially when considering the case in which the articles need to be picked up from a collection site where they are piled up in bulk.

The document EP 521206 discloses an apparatus comprising a conduit with an inlet or feed section for the admission of articles, in which a detection unit is fitted for sensing the articles orientation by two photocells positioned from opposite sides with respect to a filter-valve. The articles, being picked up from a container by means of an aspirator bidirectionally movable between the same container and the inlet section of said conduit, are made to transit, in correspondence of the above mentioned detection unit, by an air flow generated by suitable pneumatic means and causing the articles under treatment to move along a path delimited by a plurality of conduits suitably connected to each other. The above filter-valve is so disposed as to delimit, when activated, a space which only the thinner end of the article—that is, the one relevant to the toe portion—is able to go through, the end comprising the elastic hem being remarkably thicher and thus unable to cross said space. Accordingly, once the filter-valve is activated, if both the unit's photocells detect the presence of textile material in correspondence of the respective optical axes, then the in-process article results oriented with its toe turned forward, that is, in the same direction as the one of the flow which has moved it along. On the contrary, if the presence of the textile material is sensed by only the photocell which is upstream of the filter-valve, then the end of article moving forward is that of the elastic hem, since this part of the article is unable to go through the space cleared by the valve. Following the step of detection of the current orientation of the article, the latter is disengaged by moving the filter-valve back to the retracted rest position, that is, by clearing the cross-section of the articles, admission conduit. The controlled article is thereby free to follow, being entrained by the air flow purposely generated, one or the other of the two paths, delimited by conduits downstream of the unit, according to current orientation of same article. In this way, the articles exit from the apparatus with the same orientation all the time. The document (IT) FI/96/A/163 discloses an apparatus comprising a unit for detecting the current orientation of the incoming articles and means able to change the orientation thereof if it does not correspond to the intended one. Said detection unit comprises a filter-valve of a type previously indicated and a photocell located upstream thereof. The filter-valve and photocell in question are located within a main conduit in which the articles, being fed by means of an automatic arm which takes them out of a container or a heap in which they are collected in bulk, are suitably conveyed by an air flow generated by an aspirator. Also provided are ancillary conduits suitably connected to the main conduit. When the selecting valve is in active state, that is, ready to intercept articles coming, from the inlet section of the main conduit, and the same photocell detects the presence of textile material in correspondence of its optical axis, the article under treatment results oriented with its toe turned forward, that is, with its portion comprising the elastic hem being retained by the filter-valve. On the contrary, if the photocell does not give any reading, the article results oriented in a direction opposite to the previous one. To allow the articles going out of the apparatus with the same orientation all the time, means are provided apt to engage the articles in the desired way, said means being activated when the orientation detected by the photocell upstream of the filter-valve does not correspond to the intended one.

The apparatuses above described have some drawbacks. One drawback lies in the fact that the articles may disengage spontaneously from the filter-valve when presenting themselves with their toe turned forward, thereby preventing an accurate reading by the control photocells, which in turn implies a faulty data-processing and a reduced reliability of the mechanism. A further drawback stems from the need of associating one or two photocells to the filter-valve and, therefore, relying almost completely the above detection on the accuracy and correct operation of same photocells which, accordingly, need a continuous maintenance. Moreover, the heavy constructional complexity of the means which operate the onrientation of the articles as required, contributes to increasing the manufacturing cost of same means while bringing about greater difficulties in carrying out routine and extra service.

The main object of the present invention is to overcome the said drawbacks.

This result has been achieved, according to the invention, by providing an apparatus and a method having the features indicated in the characterizing part of independent claims. Further characteristics being set forth in the dependent claims.

The present invention makes it is possible to achieve the orientation and unloading of the articles as required by using an apparatus simple to make, cost-effective, reliable, of reduced dimensions, easy to inspect and requiring a minor and simplified maintenance.

These and other advantages and characteristics of the invention will be best understood by anyone skilled in the art from a reading of the following description in conjunction with the attached drawings given as a practical exemplification of the invention, but not to be considered in a limitative sense, wherein.

Figure 1:
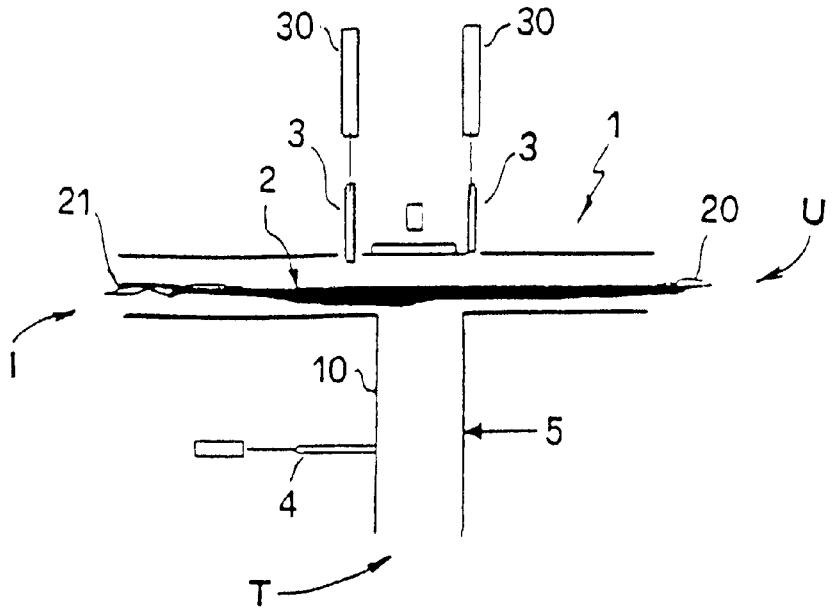
FIG. 1 is a diagrammatic view in longitudinal section of an apparatus according to the invention, with an article extending between two filter-valves which delimit the central section of the chamber (1)

Reduced to its basic structure, and reference being made to the figures of the attached drawings, an apparatus according to the invention comprises a tubular chamber (1) with an inlet section (I) and an outlet section (U) for, respectively, the admission and exit of the articles (2). Provided within said chamber (1) are two cascade filter-valves of a so-called "gate" or "guillotine" type, hereinafter referred to as "filters". Each of said filters substantially comprises a lamina (3) which goes through a corresponding slit provided in a wall of chamber (1) and bidirectionally movable under control of a relevant actuator (30). The stroke of actuators (30) is such that, when reaching its maximum extension, the front edge of each lamina (3) faces the opposite wall of chamber (1) and leaves a free space for the thinnest end (20) of the articles (2) which space cannot however be passed through by the thickest end (21). For example, in case of stockings, the thinnest end (20) corresponds to the toe, and the thickest end (21) corresponds to the elastic hem. The two filters (3, 30) determine a subdivision of the chamber (1) into three sections, that is, an inlet section (the one on the left indicated by "S" in the figures of the attached drawings), a central section (the one between the two filters (3, 30)) and an outlet section (the one on the right indicated by "D" in the figures of the attached drawings).

The said chamber (1) has a tubular branch (10) whose mouth is in correspondence of the central section of same chamber (1).

The said filters (3, 30) serve to detect the orientation of the articles (2) within the camera (1) in a manner to be described below.

Preferably, the present apparatus may exhibit, in correspondence of said branch (10), a guillotine valve (4) able to temporarily retaining a portion of the article (2) in the same branch, as necessary. Possibly associated to said valve (4) is a control photocell (5), located at a preset distance from the mouth of the branch (10), which photocell does not partecipate to the process for the detection of the instantaneous orientation of the articles (2) coming into the chamber (1) but it can be used, for example, to verify the actual presence of the textile material within the branch (10), as best described later on.

Figure 3:
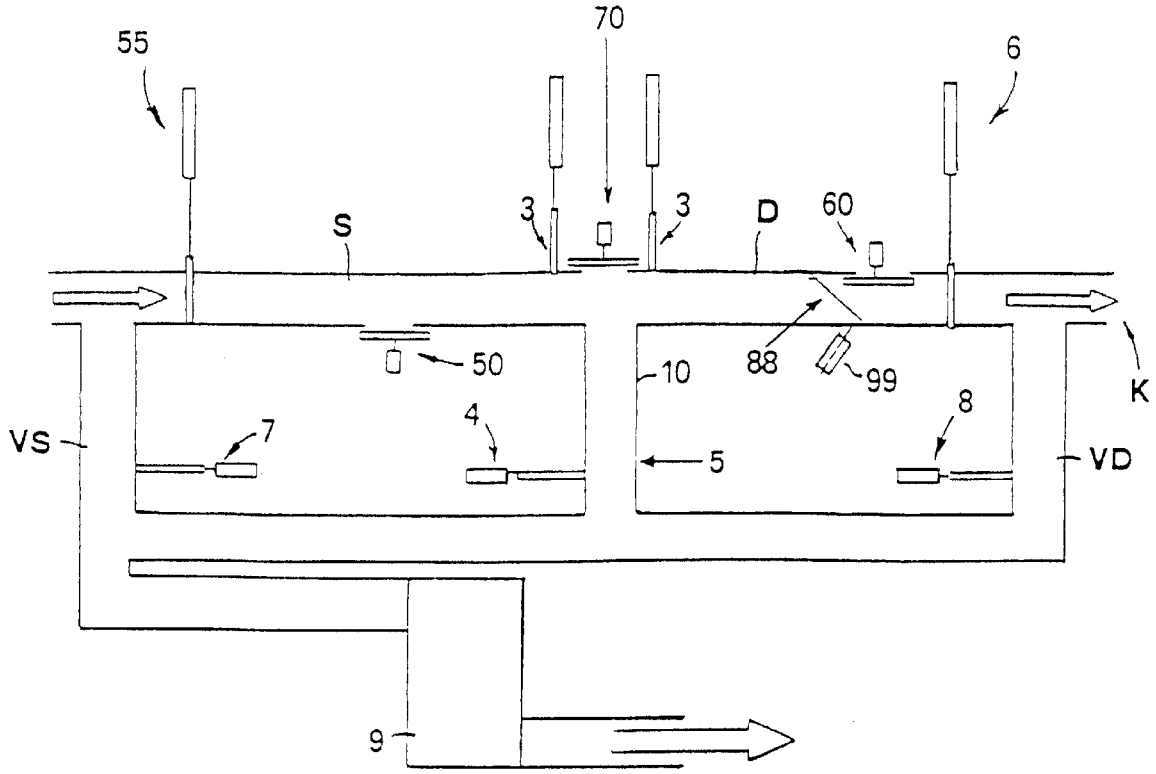
FIG. 3 is a simplified application scheme of the apparatus shown in the preceding figures.
Figure 4:
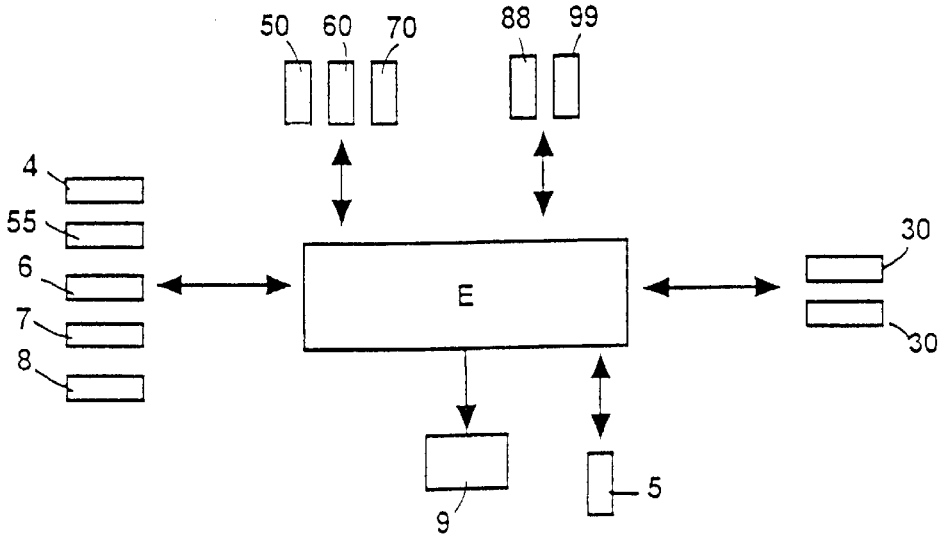
FIG. 4 is a layout outlining the system for controlling the components of the apparatus according to the invention as shown in FIG. 3, wherein "E" indicates a programmable electronic unit.

The apparatus in question may be disposed, for example, in a pneumatic circuit of a type shown in FIG. 3, wherein the valves (5), (6), (7) and (8) are fitted, respectively, in the left section (S) of the chamber, in the right section (D) of the chamber, in a vertical branch (VS) of said left section (S) and in a vertical branch (VD) of said right section (D). The valve (4) of the branch (10) of the central section of chamber (1) and the air inlets (50), (60) and (70), can be activated in a preset sequence to control the direction of the flow generated by an aspirator (9) within the chamber (1): the said sections and circuit branches being associated to the aspirator (9).

In the circuit of FIG. 3 and, more specifically, in correspondence of the right section (D) of chamber (1), at a suitable distance from the pair of filters (3), there is provided a single-handling device, of a type disclosed in the above cited document (IT) FI/96/A/163, whose function is to ensure the treatment of one article at a time. Such a device comprises a gate valve (88), able to intercept by stopping them under conntrol the incoming articles, and a presser (99) with relevant actuator. The presser (99) is so disposed and oriented as to engage and retain the fabric of the article (2) which, when activating the same presser, results at the back of the gate (88). After the activation of the presser (99), the air flow is reversed in the relevant housing conduit, that is, within the chamber (1), so that the surplus articles, if any, being not engaged by the presser (99), are unloaded from the opposite side. It will be appreciated that, in order to ensure the treatment of one article at a time, any other technique may be employed if right for the purpose. The operation of the above described apparatus is as follows.

Figure 2:
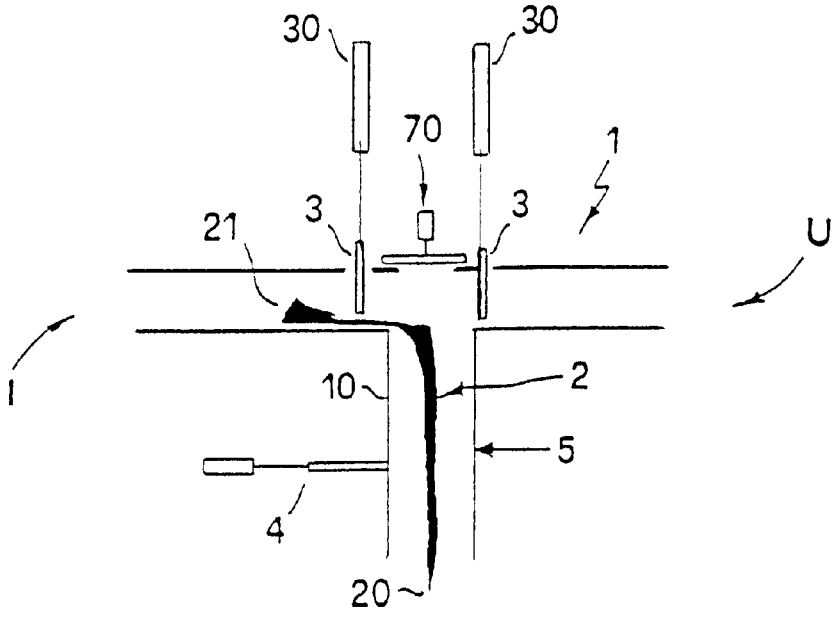
FIG. 2 is a view similar to that of FIG. 1, wherein the left valve retains the elastic hem of the article whose toe portion is sucked into the branch facing said central section.

The articles (2) are sucked into the chamber (1) by the flow generated by the aspirator (9), after programming a suitable combination of the opening/closing states of valves (4, 55, 6, 7), with the filters (3, 30) being in the inoperative condition shown in FIG. 1. Once the single-handling operation is completed by the unit (88, 99), the only article (2) present in the chamber (1) results disposed in the stretched condition shown in FIG. 1, that is, with its ends (20, 21) on opposite sides with respect to filters (3, 30). In this stage, said only article results still retained by the presser (99) of unit (88, 99). At this point, both filters (3, 30) are disposed in the operating condition shown in FIG. 2. Afterwards, the presser (99) is deactivated and vacuum is applied to suct air from the branch (10) of the central section of chamber (1). In this way, the portion comprising the thinnest end of article (2) is free to go into the branch (10), while the thickest end (the one on the left in the example of FIG. 2) is retained by the corresponding filter (3, 30). Accordingly—regardless whether the thickest end (21) is retained by the right or left filter—by re-disposing the filters (3, 30) in the inoperative state of FIG. 1, and sucting the article in the direction of section (U) of chamber (1), there is obtained the unloading of the article with the thickest edge (21) thereof turned toward the same section (U). By aspirating instead from the branch (10), there is obtained the unloading of the article (2) with the thinner edge (20) thereof being turned forward either through the outlet section (T) of branch (10) or, in an equivalent way, through the outlet section (K) of the circuit of FIG. 3.

The photocell (5) can be used to verify whether the process in question proceeds by following the established procedures. If, during the above described operating steps, provision is made for the thinnest end (20) to result within the branch (10) , and the optical axis of the photocell in question is not engaged by the fabric of the article, such condition is interpreted as an anomaly (for example, owing to the fact that one filter might engage and retain both the ends of the article in case the latter bends up accidentally). In this case, the article is released, under control, by positioning the filters (3, 30) in inoperative condition, in order to unload the same article without retaining it any further. It should be apparent from the above the constructional and functional simplicity of the present apparatus which, in addition, makes it possible to unload the articles (2) being oriented with either the thickest end (21) or thinnest end (20) turned forward, that is, in the unloading direction, according to what has been programmed.

A procedure according to the invention includes the following operating steps:

- disposing an article (2) in stretched condition between two filters (3, 30) lined up in inoperative position, so that the two ends (20, 21) of the article will result on opposite sides with respect to said filters (3, 30);
- disposing said filters (3, 30) in operative condition, so that each of them will delimit a space to be passed through only by the thinnest end (20) of the article (2);
- forcing the portion of the article (2) which includes the thinnest end (20) to pass through the space delimited by the respective filter (3, 30), by conveying the said portion within a conduit (10) whose mouth is between said filters (3, 30), so that the thickest end (21) will result retained by the other filter (3, 30);
- releasing the thickest end (21) of article (2) and moving the latter either in the direction of said conduit (10) or in the direction of alignment of filters (3, 30), depending whether it is intended to operate the unloading of article (2) with the thinnest end (20) thereof or the thickest end (21) thereof turned forward with respect to the unloading direction.

For the programmed control of the above described operating means, use may be made of a programmable electronic unit of conventional type which, therefore, is not described herein in detail. Practically, all the construction details may vary in any equivalent way as far as the shape, dimensions, elements disposition, nature of the used materials are concerned, without nevertheless departing from the scope of the adopted solution idea and, thereby, remaining within the limits of the protection granted to the present patent for industrial invention.

What is claimed is:

1. Apparatus for the automatic orientation of tubular articles having thicker and thinner ends, including stockings, comprising a tubular chamber with an inlet section and an outlet section for, respectively, the admission and exit of said articles, said tubular chamber comprising two cascade filter-valves each of which is adapted to allow passage of the thinner end while preventing passage of the thicker end, a branch whose mouth is in correspondence with the space along the chamber between said filter-valves, said apparatus further comprising an air aspirator adapted in conjunction with said filter-valves and said outlet section to selectively orient said tubular articles such that either said thicker or said thinner end is a leading end.

2. Apparatus according to claim 1, characterized in that it is provided with programmable electronic means for the operation of its components.

3. Apparatus according to claim 1, characterized in that it is provided with single-handling means which are able to ensure the treatment of only one article at a time.

4. Apparatus according to claim 3, characterized in that it is provided with programmable electronic means for the operation of its components.

5. Apparatus according to claim 1, characterized in that it comprises a photocell for controlling the operations, the optical axis of the photocell being within said branch (10) and at a predetermined distance from the mouth thereof.

6. Apparatus according to claim 5, characterized in that it is provided with single-handling means which are able to ensure the treatment of only one article at a time.

7. Apparatus according to claim 5, characterized in that it is provided with programmable electronic means for the operation of its components.

* * * * *